US005397067A

United States Patent [19]

Akiyama et al.

[11] Patent Number: 5,397,067

[45] Date of Patent: Mar. 14, 1995

[54] METHOD OF PRODUCING BAMBOO FIBERS

[75] Inventors: Norihito Akiyama; Kazuo Sakamoto; Motonobu Abe; Shoichiro Irie, all of Yokohama, Japan

[73] Assignees: ASK Corporation; Sanshin Thermal Insulation Co., Ltd., both of Yokohama, Japan

[21] Appl. No.: 178,354

[22] Filed: Jan. 4, 1994

Related U.S. Application Data

[63] Continuation of Ser. No. 990,508, Dec. 15, 1992, abandoned.

[30] Foreign Application Priority Data

Jul. 3, 1992 [JP] Japan ..... 4-177070

[51] Int. Cl.[6] ..... B02C 21/02

[52] U.S. Cl. ..... 241/28; 241/20

[58] Field of Search ..... 241/20, 28, 29; 162/94

[56] References Cited

U.S. PATENT DOCUMENTS

| | | | |
|---|---|---|---|
| 1,399,891 | 12/1921 | Scott | 241/20 |
| 2,729,856 | 1/1956 | Horton et al. | 241/28 X |
| 2,929,756 | 3/1960 | Schuh | 241/28 X |
| 3,216,886 | 11/1965 | Katzen | 241/28 X |
| 4,202,078 | 5/1980 | Malinak | 241/188.1 X |
| 4,231,136 | 11/1980 | Villavicencio | 241/154 X |
| 4,641,792 | 2/1987 | Villavicencio et al. | 241/188.1 X |
| 4,857,145 | 8/1989 | Villavicencio | 162/94 X |
| 5,178,335 | 1/1993 | Mertens | 241/101.2 X |

FOREIGN PATENT DOCUMENTS

| | | |
|---|---|---|
| 58-8339 | 2/1983 | Japan . |
| 63-7903 | 1/1988 | Japan . |
| 311342 | 5/1930 | United Kingdom . |
| 342672 | 1/1931 | United Kingdom . |
| 357574 | 9/1931 | United Kingdom . |
| 410358 | 5/1934 | United Kingdom . |
| 857988 | 1/1961 | United Kingdom . |

*Primary Examiner*—Frances Han

*Attorney, Agent, or Firm*—Oblon, Spivak, McClelland, Maier & Neustadt

[57] ABSTRACT

A method of producing bamboo fibers comprese a first step of crushing bamboo in the direction of growth thereof by a rolling machine; a second step of fiberizing the crushed bamboo, obtained in the first step, by a hammer-mill-type grinding machine; and a third step of separating an inner thin skin portion of the bamboo, mixed in with the bamboo fibers obtained in the second step, from the bamboo fibers.

2 Claims, 2 Drawing Sheets

METHOD OF PRODUCING BAMBOO FIBERS

This application is a continuation of application Ser. No. 07/990,508, filed on Dec. 15, 1992, now abandoned.

BACKGROUND OF THE INVENTION

1. Field of the invention

This invention relates to an effective and efficient method of producing bamboo fibers in which the inner thin skin portion (medullary layer) of bamboo has been removed.

2. Description of the Related Art

A method of producing fibers from bamboo has been proposed, for example, in Japanese Patent Laid-Open No. 63-7903, according to which bamboo fibers are obtained by explosive opening, which results in large variations in length and diameter of the obtained bamboo fibers. Thus, the method cannot be regarded as ideal for the production of fibers as a material for industrial use.

In view of this, the present inventors have proposed a method of producing bamboo fibers quickly and efficiently (Japanese Patent Application Nos. 2-402672 and 3-193161) and, through subsequent study, they have found that, to produce bamboo fibers as a material for industrial use, it was desirable to remove the thin portion inside the bamboo. In this case, for example, of bamboo-fiber reinforced cement panels which are produced by mixing bamboo fibers with cement and shaping the mixture into panels, use of bamboo fibers from which the inner thin skin portion has been removed provides a flexural strength approximately 15% higher than when using bamboo fibers with the inner thin skin portion.

SUMMARY OF THE INVENTION

Accordingly, an object of the present invention is to provide a method which makes it possible to obtain bamboo fibers in which the inner thin skin portion has been separated out.

In accordance with this invention, there is provided a method for producing bamboo fibers comprising a first step of crushing bamboo in the direction of its growth by means of a rolling machine; a second step of fiberizing the crushed bamboo, obtained in the first step, by means of a hammer-mill-type grinding machine having a specific mechanism: and a third step of separating the inner thin skin portion of bamboo from the bamboo fibers obtained in the second step.

DETAILED DESCRIPTION OF THE INVENTION

The present invention will now be described in detail.

Figure 1:
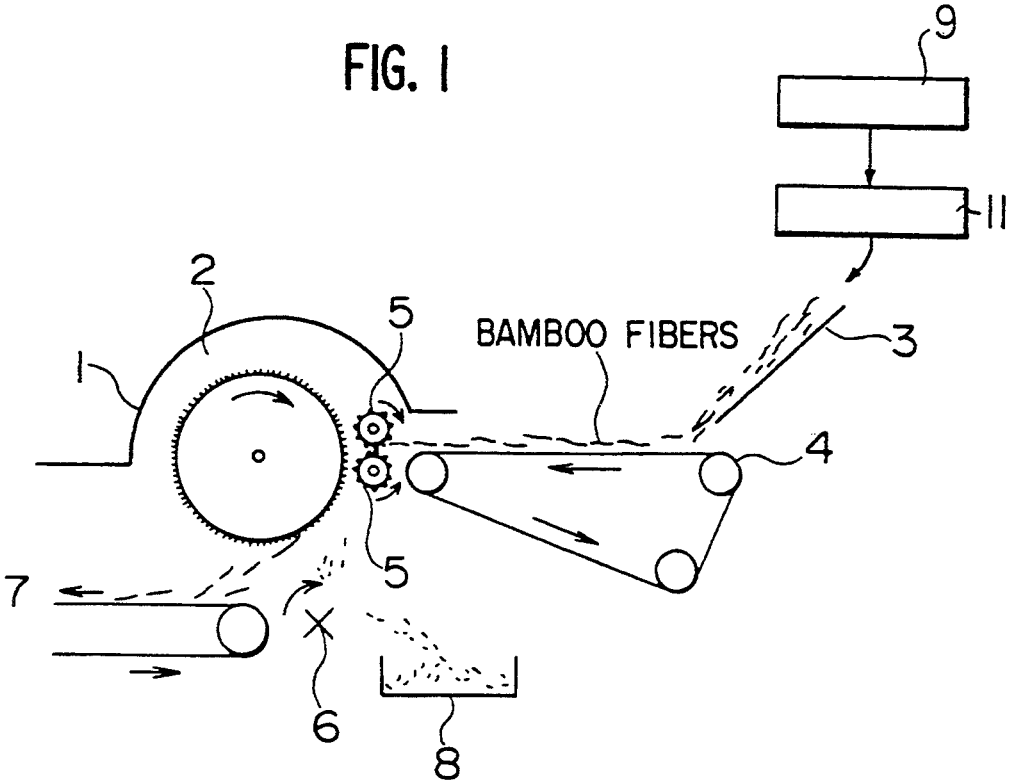
Fig. 1 is a schematic diagram showing an apparatus used in the third step of the method of the invention.

In accordance with this invention, bamboo is first crushed by a rolling machine 9 schematically illustrated in FIG. 1 and then fiberized by a hammer-mill-type grinding machine 11 also schematically illustrated in FIG. 1. The inner thin skin portion of the bamboo existing in the bamboo fibers is then separated therefrom.

First, leaves are removed from the felled bamboo, which is then passed through a rolling machine as it is or after being cut into pieces of a predetermined size, and is crushed by the rolling machine. The rolling machine 9 used in the first step of the method of this invention may be a generally used-type such as a roll-type rolling machine or a stamping-type rolling machine. When the bamboo is cut into pieces, the size of the pieces must naturally be equal to or larger than the length of the fibers to be produced.

After the first step, the crushed bamboo is fiberized in the second step by using a hammer-mill-type grinding machine 11 In the present invention the grinding machine may be a horizontal-type grinding machine such as an MHM series manufactured by Miike Tekkosho K.K., which machine comprises a hammer of a special configuration (fixed or suspended type). The hammer is attached to a tool holder (hammer holder) provided on the main spindle adapted to rotate at high speed. Bamboo is continuously fed into a hopper and instantaneously crushed to be fiberized by the impact cutting and crushing action of the hammer rotating at high speed, with the end of the hammer being appropriately spaced apart from the tool holder positioned above. The fibers are then adjusted to a desired length as they pass through a screen provided below, and are then continuously discharged from the grinding machine, thus providing bamboo fibers. It is not desirable to skip over the first step and process bamboo directly in the second step since most of the bamboo will then be pulverized, resulting in a substantial reduction in the yield of fibers.

In the third step of this invention, the inner thin skin portion of bamboo, mixed in with the bamboo fibers obtained in the second step, is separated therefrom. The operation of the third step can be conducted (1) by a mechanical process or (2) immersion process in water.

(1) Mechanical separation:

The mechanical separation process can be conducted by using, for example, an apparatus as shown in FIG. 1. This apparatus is based on an opening machine. The bamboo fibers obtained in the second step are supplied from a chute 3 through a feed conveyor 4 to a pair of feeding rolls 5, from which they are scattered onto a conveyor 7 by way of a number of triangular teeth on a rotating drum 2 provided inside a housing 1. The rotating drum 2 is operated at high speed (at approximately 1000 r.p.m). The conveyor 7 only extends up to a position near the center line of the rotating drum 2, and the thin skin portion of the bamboo generally falls short of the conveyor and is collected in a thin skin portion collecting vessel 8 by a blade 6 that is mounted under the conveyor 7.

Figure 2:
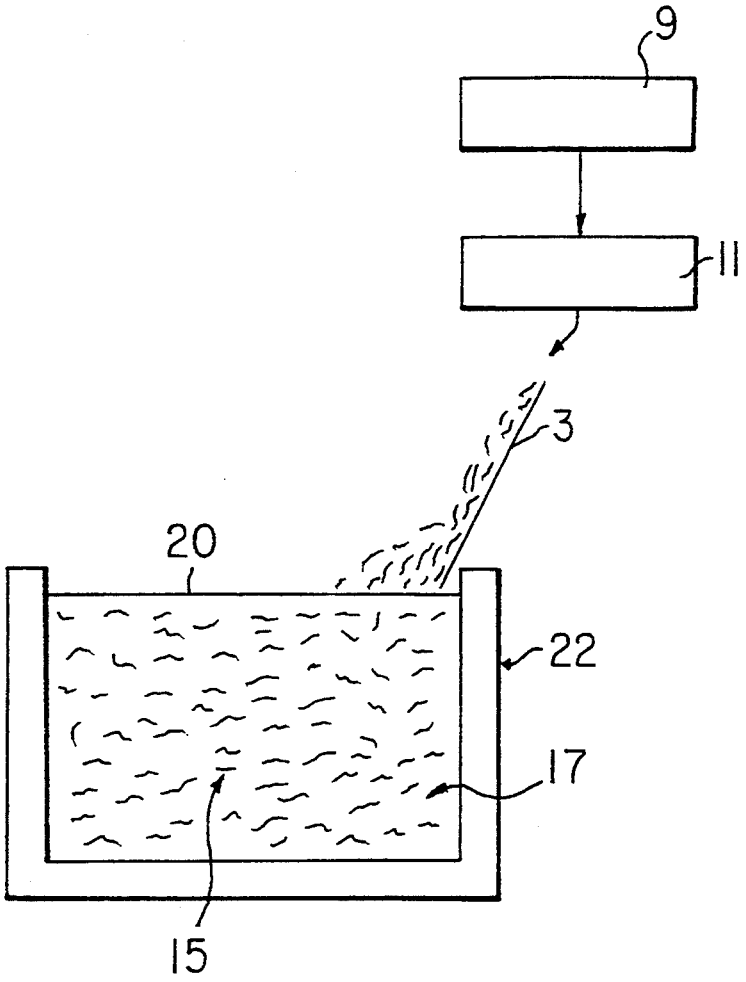
FIG. 2 is a schematic diagram of an alternative embodiment of the separation process of the present invention.

(2) Separation by immersion in water:

FIG. 2 schematically illustrates the separation by immersion in water by utilizing a water pool 22. When the bamboo fibers (identified by reference numeral 15 in FIG. 2.) obtained in the second step are immersed in water 17, the thin skin portion 20 of the bamboo, which is mixed in with bamboo fibers 15, floats on the surface of the water 17 as fragments. By removing these fragments, the bamboo fibers and the thin skin portion can be easily separated from each other.

EXAMPLE

The method of the present invention will be illustrated with reference to the following example, to which the invention is not intended to be limited.

Example 1

(1) First step for crushing bamboo by rolling:

The first step was executed by using a rolling machine equipped with a roll made of carbon steel (S45C) and having a diameter of 150mm, and an effective roll length of 500mm. The rolling operation was performed under the following condition: pressure: 25 kg/cm$^2$; feeding roll speed: 15m/min.; and production rate: 180kg/hour. The bamboo used had been cut into pieces having a length of approximately 1m after having the leaves were removed.

By the first step, the bamboo was split into sheaves along the direction of growth, each sheaf exhibiting a multitude of slits at intervals of approximately 0.1 to 3mm extending in the direction of growth.

(2) Second step for fiberizing bamboo by a hammer-mill-type grinding machine:

An MHM horizontal-type grinding machine manufactured by Miike Tekkosho K.K. was used as the hammer-mill-type grinding machine. A screen having a diameter of 25mm was provided at the bottom of the grinding machine, which was operated at 30 h.p. for one hour, thereby producing 120kg of bamboo fibers having a fiber length of 25mm. At this stage, the inner thin skin portion of bamboo was separated from and mixed in the bamboo fibers.

(3) Third step for separating the inner thin skin portion from the bamboo fibers:

(1) Mechanical separation

The drum 2 was rotated at a speed of approximately 1000 r.p.m., using an IM-34-type opening machine manufactured by Izuminami Seishinjo to effect separation. Assuming that the weight of the bamboo subjected to the first step when in the dry condition was 100%, the yield of bamboo fibers was: 97%, after the first step; 80%, after the second step; and 75%, after the third step, with no thin skin portion existing in the bamboo fibers finally obtained.

(2) Separation by immersion in water

The bamboo fibers obtained in the second step were immersed in water, and the thin skin portion, floating on the surface of the water as fragments, was removed as illustrated in FIG. 2.

Upon visual inspection, practically no thin skin portion was found in the bamboo fibers processed by either method (1) or (2).

Thus, the bamboo fiber producing method of this invention makes it possible to obtain bamboo fibers in which the inner thin skin portion of bamboo has been removed.

What is claimed is:

1. A method for producing bamboo fibers comprising the steps of:

crushing bamboo in a direction of growth thereof by a rolling machine which is a roll-type or stamping-type rolling machine;

fiberizing the crushed bamboo by a hammer-mill-type grinding machine to form fibers and inner skin portions;

conveying the inner thin skin portions of the bamboo mixed in with the bamboo fibers obtained in said fiberizing step to a first conveyor; and separating the inner thin skin portion of the bamboo from the bamboo fibers by a mechanical process in which the inner thin skin portion and the bamboo fibers are conveyed by said first conveyor to a pair of feeding rolls, the bamboo fibers are scattered by said feeding rolls onto a second conveyor, and the inner thin skin portion conveyed by said feeding rolls falls short of said second conveyor and is collected in a collecting vessel.

2. A method of producing bamboo fibers comprising the steps of:

crushing bamboo in a direction of growth thereof by a rolling machine which is a roll-type or stamping-type rolling machine;

fiberizing the crushed bamboo by a hammer-mill-type grinding machine to form bamboo fibers and inner skin portions; and separating an inner thin skin portion of the bamboo fibers obtained in said fiberizing step from the bamboo fibers by immersing the inner thin skin portion and the bamboo fibers in water so as to cause the inner thin skin portion to float to the surface of the water and thereafter permit the removal of the inner thin skin portion from the water.

* * * * *